United States Patent [19]

Frykendahl

[11] Patent Number: 4,566,614

[45] Date of Patent: Jan. 28, 1986

[54] CASTING NOZZLE

[76] Inventor: Björn Frykendahl, Ljungvalls väg 6, 683 00 Hagfors, Sweden

[21] Appl. No.: 541,053

[22] Filed: Oct. 12, 1983

[30] Foreign Application Priority Data

Oct. 15, 1982 [SE] Sweden ..... 8205881

[51] Int. Cl.[4] ..... B22D 37/00

[52] U.S. Cl. ..... 222/603; 222/591; 222/606

[58] Field of Search ..... 222/603, 591, 606, 607, 222/590, 600; 164/337, 437, 438; 266/236, 266

[56] References Cited

U.S. PATENT DOCUMENTS 3,502,134 3/1970 Orehoski ..... 222/591 X
3,502,249 3/1970 Wagstaff ..... 222/603
3,917,110 11/1975 Kiguchi ..... 222/597 X
4,064,925 12/1977 Fastner et al. ..... 164/437 X
4,202,533 5/1980 Daussan et al. ..... 164/437 X
4,410,112 10/1983 Fasano et al. ..... 222/602

*Primary Examiner*—Joseph J. Rolla
*Assistant Examiner*—Nils E. Pedersen
*Attorney, Agent, or Firm*—LeBlanc, Nolan, Shur & Nies

[57] ABSTRACT

A casting nozzle (1) at metallurgical processes, through which nozzle a metal bath is intended to flow out, where gas, such as argon or nitrogen gas or a mixture of gas and powderous material, is intended by means of an injection lance or the like to be injected into the bath in connection to the nozzle.

The casting nozzle according to the invention is especially characterized, in that the through hole (2) of the nozzle (1) has substantially conic shape, with a cross-sectional area increasing in the intended flow direction.

9 Claims, 6 Drawing Figures

CASTING NOZZLE

Figure 1:
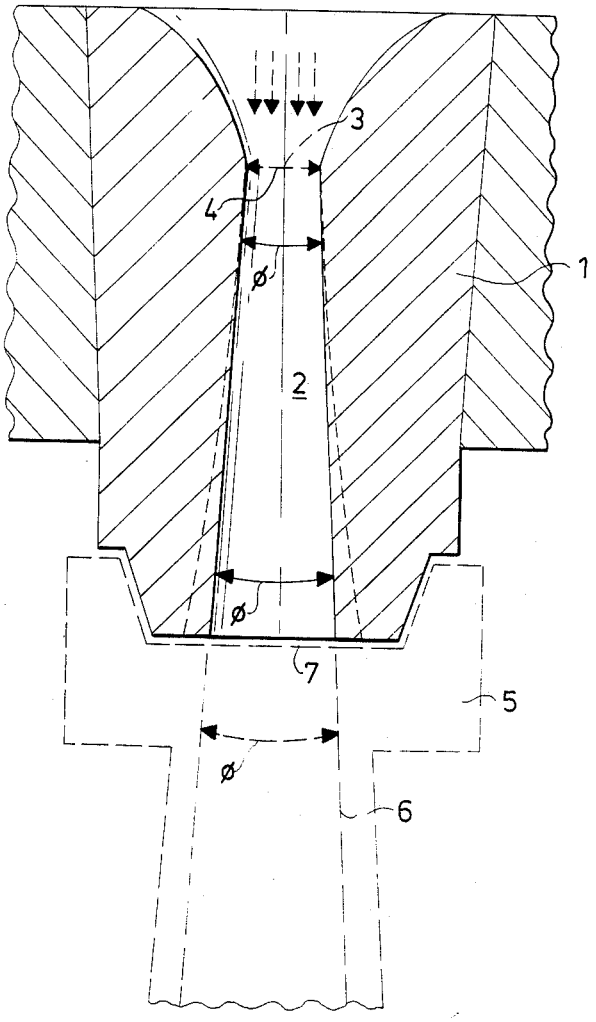

This invention relates to a casting nozzle, through which molten bath is intended to flow out, where gas, such as argon or nitrogen gas, or a mixture of gas and powdered material is intended to be injected into the bath in connection to the nozzle by means of an injection lance or corresponding device.

The addition of gas or a mixture of gas and material, such as metal powder or non-metallic powder, for example oxide or carbide powder, via an injection lance in a nozzle is included as a partial operation in different process-metallurgical methods.

At current degasification of steel, thus, about 300 N1 argon gas per tonne steel is added centrally at the upper portion of the nozzle, for example by means of a lance. The gas is hereby heated and expands considerably, whereby the bath is disintegrated, burst into small fragments, which is the object. The disintegration is facilitated by applying vacuum beneath the nozzle.

At continuous casting a method is used, at which argon gas via a stopper end is flushed in an amount of about 10 N1 per tonne bath into the casting nozzle. The object in this case is to purify the steel from slag particles etc., in that the gas follows along with the steel down into the bath pool, which is in connection with the ingot mould, and thereafter slowly arises in the form of small bubbles whereby simultaneously slag particles etc. are transported upward.

At the method according to SE-PS 7706696-7, a gas-powder mixture is injected into the casting nozzle. The object a.o. is that the material transported with the gas, i.e. the powder, shall cool the bath and the ingot formed from within and thereby refine the primary casting structure. The material added may be metal powder with a composition similar to that of the bath and/or another material, as for example a wear-resistant carbide at the casting of tool steels. Hereby it is possible to manufacture composite material, for example synthetic steels, where a favourable microstructure can be developed more independently, i.e. without the relatively heavy restrictions as in the case of conventional methods. At the method according to said patent, the gas amount is relatively great, such as 1–10 $Nm^3$ per tonne bath and 15–80 N1 per kg injected material.

At all of the aforesaid methods the gas expands in the nozzle, and the degree of expansion depends a.o. (among other things), on the gas flow in relation to the bath flow, the jet geometry and the nozzle length. When the gas is not allowed to expand sufficiently in the nozzle, often strong pulsations arise which often result in cloggings in the nozzle or in casting pipes connected to the nozzle. Hereby breakdowns are caused which, of course, are undesired.

The present invention solves the problems referred to above and thereby a higher operational reliability is obtained.

The present invention, thus, relates to a casting nozzle at metallurgical processes, through which nozzle a metal bath is intended to flow out, where gas, such as argon or nitrogen gas or a mixture of gas and powderous material is intended to be injected by means of an injection lance or the like into the bath in connection to the nozzle.

The device according to the invention is especially characterized in that the flow hole of the nozzle has substantially cone shape with a cross-sectional area increasing in the intended flow direction.

Figure 2:
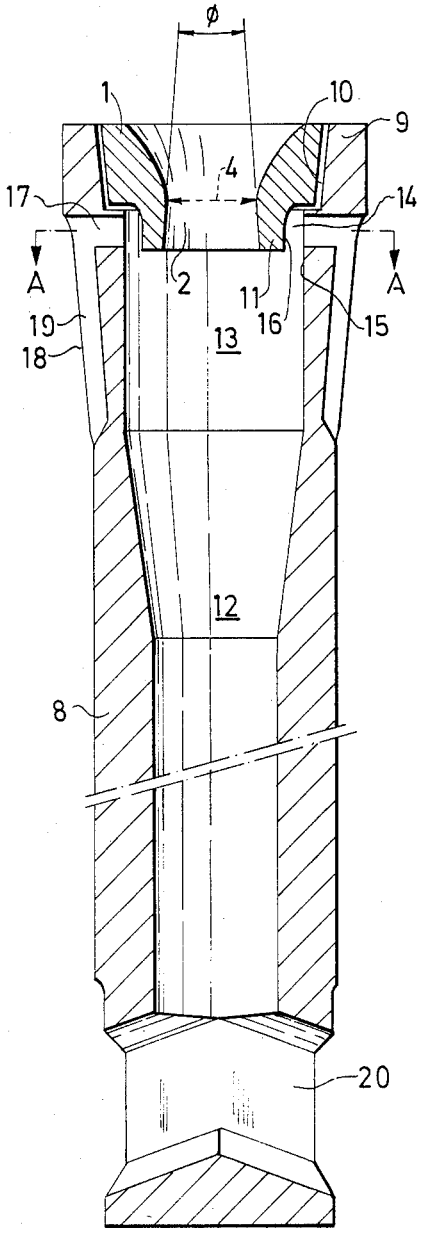
Figure 4:
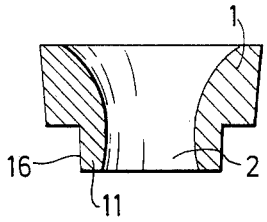
Figure 3:
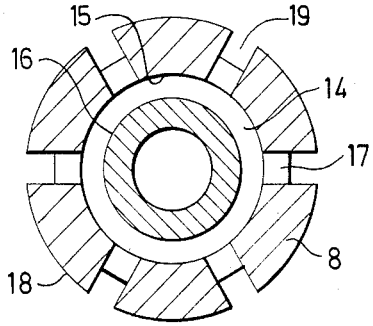
Figure 5:
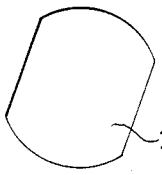
Figure 6:
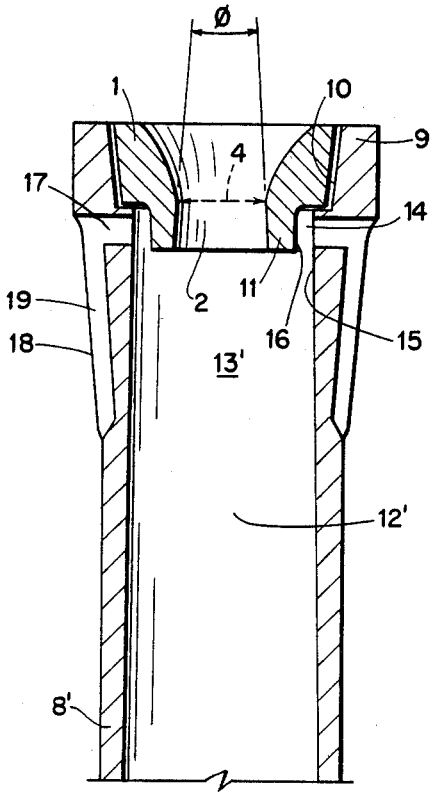

The invention is described in greater detail in the following, with reference to an embodiment and to the accompanying drawings, in which FIG. 1 is a vertical section through a first embodiment of a casting nozzle according to the invention where also a first embodiment of a casting pipe cooperating with the nozzle is shown schematically, FIG. 2 is a vertical section through a second embodiment of a casting nozzle according to the invention where also a second embodiment of a casting pipe cooperating with the nozzle is shown, FIG. 3 is a section A-A according to FIG. 2, FIG. 4 shows the casting nozzle according to FIG. 2 separately, FIG. 5 shows the design of the outlet holes of the casting pipe according to FIG. 2, and FIG. 6 is a vertical section through a further embodiment of a casting nozzle in which the casting pipe through passageway is conically divergent and has upper outlet holes similar to that seen in FIG. 2.

In FIG. 1 the numeral 1 designates a casting nozzle, through which a metal bath is intended to flow out, where gas, such as argon or nitrogen as, is intended by means of an injection lance or the like, not shown, to be injected into the bath in connection to the nozzle. 2 designates the flow hole of the nozzle 1.

According to the invention, the flow hole 2 has conic shape, with continuously increasing diameter, so that the cross-sectional area of the hole 2 increases in the intended flow direction, as appears from FIG. 1. An ideal design of the flow hole, however, is the Laval-design, a convergent-divergent nozzle passage with a constantly changing convergency at its inlet passing through into a divergent passage to its outlet. This shape is well known in fluid and gas dynamics as a De Laval nozzle, and is what the term Laval-design refers to. A purely conic design, however, is acceptable and offers a.o. advantages from a manufacturing aspect. The conicity, measured as angle $\phi$, is chosen in view of the operation parameters, for example gas volume per tonne bath, jet geometry and to some extent the length of the outlet hole 2.

At injection into the steel bath under such conditions that the cross-sectional area of the injection jet, indicated by vertical dashed arrows in FIG. 1, is about 50% of that of the throttling area of the nozzle 1, i.e. the area at the narrowest portion 4 of the flow hole 2 as indicated by the dashed arrow 3, a mean conicity $\phi$ of the through hole is 5°–8°. At deviations from said 50%, the conicity is adjusted by increase or reduction substantially in direct proportion to the deviation.

The casting nozzle, thus, is provided for injection substantially vertically and centrally into the bath at the upper portion of the nozzle, at which portion bath is supplied to the nozzle, where the through hole 2 of the nozzle, from the narrowest portion 4 of the through hole constituting the throttling area of the through hole, to the outlet opening of the through hole, at which outlet hole the bath and gas are intended to flow out of the nozzle, has substantially conic shape, whereby the cross-sectional area of the through hole increases continuously from the narrowest portion 4 to the outlet opening, and where the continuous increase in area is adjusted so as to at least correspond to the expansion of the gas as a result of the continuous increase in temperature of the gas at its passage through the nozzle.

When using a first embodiment of a casting pipe 5 shown schematically in FIG. 1, according to the invention the through holes 2,6 of the nozzle 1 and, respectively, casting pipe 5 have substantially the same conicity and substantially the same diameter or corresponding measure in the transition 7 between the nozzle 1 and casting pipe 5.

At the second embodiment of nozzle and casting pipe according to the invention shown in FIGS. 2–5, the nozzle 1 is formed as described above, i.e. conically from the throttling area to the outlet opening. The through hole 2 here is slightly shorter than at the nozzle shown in FIG. 1.

The casting pipe 8 is adjusted to gas injection and to the nozzle 1 according to the invention. The casting pipe 8 comprises at its upper portion 9 a seat 10, into which the nozzle 1 is intended to be inserted to fit, whereby the lower portion 11 of the nozzle, which comprises the outlet opening, freely projects down into the upper portion 13 of the through hole or through passageway 12 of the casting pipe. The upper portion of the through passageway of the casting pipe 8 is significantly wider than the outlet opening of the nozzle, and has such a size that a gap 14 is formed between the wall 15 of the through passageway 12 at the upper portion 13 and the outer wall of the downward projecting portion 11 of the nozzle, whereby sufficient space is provided for the gas to expand or to pass through the nozzle. For discharging gas from the passageway 12, the upper portion 13, the casting pipe is provided at the upper part of the portion 13 with at least one outlet hole 17, which is the evacuation hole for the gas. At the embodiment shown here, the holes 17 are six in number and located equally spaced along the circumference of the casting pipe. The holes 17 are arranged so that they at least partially, but preferably entirely are covered or shielded off by the downward projecting portion 11 of the nozzle, whereby a.o. splash etc. is prevented from passing out through the holes 17. At each hole 17 a slit 19 is located, when adjoins the hole, and in the outer wall 18 of the casting pipe extends downward along the casting pipe from the hole 17. The embodiment shown in FIG. 6 is similar to that of FIG. 2 excepting the passageway 12' from upper portion 13' of the casting pipe 8' on to its end is conically divergent.

At the embodiment of casting pipe shown in FIGS. 2–5, the through passageway 12 below the upper portion 13 first tapers to a smaller cross-section than at the portion 13 and thereafter is formed with constant cross-section all the way to the outlet hole 20 adjoining the passageway 12, and in this case is formed as two opposed, transversely and slightly downward directed passageways 20.

The function of the casting nozzle according to the invention substantially should have become apparent from the aforesaid. By the Laval-design or conical design of the through hole 2 of the nozzle 1 space is provided for the gas expansion occurring due to the temperature increase. The necessary conicity, of course, depends on the process conditions. The conicity of the casting pipe 5, of course, has the same function. The increase in area at the outlet in the portion 13 of the casting pipe 8 according to FIGS. 2–5, of course, also has this function. At the casting pipe 8 possibility for evacuating gas through the holes 17 is provided.

By a nozzle according to the invention the problems referred to in the introductory portion above are solved, i.e. the injection can take place substantially without pulsations and with a small risk of cloggings.

The invention has been described above with reference to two embodiments. More embodiments and minor alterations, of course, can be imagined without abandoning the invention idea. Designs, for example, between the Laval-design and the purely conic design can be imagined.

In FIG. 1 an approximate Laval-design has been indicated by dashed lines. At the Laval-design the casting pipe 5 can be adjusted to Laval or, for example, be formed straight conically, substantially as shown in FIG. 1.

Regarding the casting-pipes, the embodiment according to FIG. 1 is suitable for casting situations at which the outlet end of the casting-pipe 5 is situated above the surface of cast steel and large amounts of gas are to be injected. The embodiment according to FIG. 2 is suitable for casting situations at which the outlet end of the casting pipe 8 is situated below the surface of the cast steel and large amounts of gas are to be injected.

Of course a combination is possible, i.e. the casting pipe 5 according to FIG. 1 may be provided with evacuation holes substantially as at the embodiment of FIG. 2, whereby an embodiment is reached at which evacuation holes are provided and at which the through passageway 12 of the casting-pipe of FIG. 2 is substantially conically shaped and preferably shorter than in FIG. 2.

The embodiment of casting-pipe 5 according to FIG. 1 is suitable for casting of billets and the embodiment according to FIG. 2 is suitable for casting of blooms and slabs, at which the cross-sectional area is relatively large.

The invention, thus, must not be regarded restricted to the embodiments set forth above, but can be varied within the scope of the attached claims.

I claim:

1. A casting nozzle and casting pipe combination for metallurgical process, through which nozzle a metal bath is intended to flow out, where gas, such as argon or nitrogen gas or a mixture of gas and powderous material, is intended by means of an injection lance or the like to be injected as a jet stream into the bath in connection to the nozzle, characterized in that the through hole (2) of the nozzle (1) is shaped substantially conically, with a cross-sectional area increasing in the intended flow direction, said pipe having (1) a seat (10) or the like at the upper end (9) of the casting pipe (8) to enable said nozzle to co-operate with the casting pipe (8), so that a lower portion (11) of the casting nozzle (1) comprising the outlet opening of the through hole (2) freely projects down in an upper portion (13) of the through passageway (12) of the casting pipe, and that said upper portion (13) has such a width, that a gap (14) is formed between the wall (15) of the through passageway (12) and outer wall (16) of the downward projecting portion (11) of the nozzle, and that the casting pipe at the upper portion (13) comprises at least one evacuation hole (17) for gas.

2. A casting nozzle as defined in claim 1, characterized in that the through hole (2) has a substantially De Laval nozzle contour.

3. A casting nozzle as defined in claim 1 for use at injection into steel bath where the cross-sectional area of the injection jet stream is about 50% of the throttling area (4) of the nozzle (1), characterized in that the mean conicity ($\phi$) of the through hole (2) is 5°–8° relative to the nozzle axis.

4. A casting nozzle as defined in claim 3, characterized in that at deviations from said 50% the conicity is constructed to have an increase or reduction substantially in direct proportion to said deviation.

5. A casting nozzle as defined in claim 1, characterized by plural evacuation holes wherein said evacuation holes (17) are located so that they are intended at least partially, but preferably entirely to be covered or shielded off by the downward projection portion (11) of the nozzle (1).

6. A casting nozzle as defined in claim 5, characterized in that at each evacuation hole (17) a slit (19) is located, which adjoins the hole, is located in the outer wall (18) of the pipe and extends downward along the casting pipe from the hole (17).

7. A casting nozzle as defined in claim 1, characterized in that the through passageway (12) of the casting pipe (8) below the upper portion (13) tapers and thereafter is formed with a substantially constant cross-section to an outlet hole (20) at the lower portion of the casting pipe.

8. A casting nozzle as defined in claim 1, characterized in that the through passageway of the casting-pipe is substantially conically shaped with a cross-sectional area increasing in the intended flow direction.

9. A casting nozzle as defined in claim 8, characterized in that the through passageway of the casting-pipe has substantially the same conicity ($\phi$) as the through hole (2) of the casting nozzle (1).

* * * * *